United States Patent [19]

Nordmann et al.

[11] Patent Number: 5,063,825

[45] Date of Patent: Nov. 12, 1991

[54] INJECTION DEVICE FOR FLUID PROPELLANTS FOR A GUN AND A FLUID PROPELLANT GUN ITSELF

[75] Inventors: Adolf Nordmann, Erkrath; Erich Zielinski, Haan, both of Fed. Rep. of Germany

[73] Assignee: Rheinmetall GmbH, Düsseldorf, Fed. Rep. of Germany

[21] Appl. No.: 948,091

[22] Filed: Dec. 24, 1986

[30] Foreign Application Priority Data

Dec. 28, 1985 [DE] Fed. Rep. of Germany ..... 3546234

[51] Int. Cl.[5] ..... F41A 1/04

[52] U.S. Cl. ..... 89/7; 89/1.1

[58] Field of Search ..... 89/7, 8, 1.1

[56] References Cited

U.S. PATENT DOCUMENTS

| | | | |
|---|---|---|---|
| 3,763,739 | 10/1973 | Tassie | 89/7 |
| 4,023,463 | 5/1977 | Tassie | 89/7 |
| 4,337,685 | 7/1982 | Munding et al. | 89/7 |
| 4,341,147 | 7/1982 | Mayer | 89/7 |
| 4,586,422 | 5/1986 | Magoon | 89/7 |
| 4,603,615 | 8/1986 | Ashley | 89/7 |

*Primary Examiner*—David H. Brown

*Attorney, Agent, or Firm*—Spencer & Frank

[57] ABSTRACT

An injection device for fluid propellants for a fluid propellant gun. The device includes at least one pump chamber for receiving a propellant, with one pump piston movable in each pump chamber. A slide is provided for opening and closing apertures in an injector surface which at least partially surrounds the gun's combustion chamber and which is arranged approximately radially to the projectile ejection direction. The slide and pump piston are configured as mutually freely movable components and a mechanism for developing a pressure is provided for displacing the slide by such pressure.

30 Claims, 2 Drawing Sheets

INJECTION DEVICE FOR FLUID PROPELLANTS FOR A GUN AND A FLUID PROPELLANT GUN ITSELF

RELATED APPLICATIONS

This application is related to U.S. application Ser. No. 948,092, filing concurrently herewith by the same inventors, the disclosure of which is incorporated by reference.

BACKGROUND OF THE INVENTION

The present invention relates to an injection device for fluid propellants for guns, with the injection device including a pump chamber for accommodating the propellant, a pump piston axially movable therein as well as a slide for opening and closing apertures in an injector surface which at least partially surrounds a combustion chamber and which is oriented approximately radially with respect to the direction of projectile ejection, and to a fluid propellant gun having at least one of these injection devices.

Such an arrangement is disclosed in German Patent No. 2,226,175 and corresponding U.S. Pat. No. 3,763,739 to Douglas P. Tassie which relates to a valve for controlling the propellant supply into the combustion chamber of an automatic weapon. The weapon here includes a weapon housing in which a barrel having a bore is rigidly fixed. The rear end of the bore is subdivided into chambers so as to accommodate a projectile and to form a combustion chamber whose end opposite the projectile is sealed by a breechblock. The circumferential face of the combustion chamber between the projectile chamber and the breechblock is partially designed as an injector surface. The term "injector surface" is to be understood herein to mean a surface provided with a plurality of apertures (injection nozzles) through which the fluid propellant is injected into the combustion chamber.

A control slide rigidly fastened to a pump piston and movable thereby makes it possible to expose, the influx opening cross section of the injector surface by appropriate displacement. The displacement results from a cam arrangement and is defined to that extent.

German Patent No. 1,728,077 discloses a differential pressure piston combustion chamber system for generating propellant gases, particularly for firearms. The propellant and the oxygen or, more precisely, the oxygen carrier are injected into the combustion chamber axially with respect to the direction of projectile ejection by way of corresponding intake conduits and chambers. The partial quantities of the two propellant components injected into the combustion chamber react hypergolically. With initiation of the combustion process, the pressure in the combustion chamber increases and drives the differential piston back, thus causing further injection of the further quantity of the two propellant components stored in the dosaging chambers.

German Offenlegunsschrift [laid open patent application] 2,725,925 and corresponding U.S. Pat. No. 4,023,463 to Douglas P. Tassie disclose a pumping device for a gun operated with a fluid propellant. The propellant introduced into a pump chamber is injected axially into the combustion chamber by way of channels disposed in the head section of a pump piston. A displaceable sleeve arranged coaxially with the pump piston has an enlarged head which serves to control the flow and quantity of the propellant.

All of the above prior art arrangements are relatively complicated in their structural design and in the association of the individual components as well as their sequences of movement. A particular drawback, however, is that the quantity of propellant can be measured out, if at all, only within limits and in a complicated manner. Emptying of the pump chamber, for example in the arrangement disclosed in German Patent No. 2,226,175 and corresponding U.S. Pat. No. 3,763,739, is also limited. Moreover, the mechanically moved parts permit displacement only within narrow geometric limits.

Different projectiles require different propellant supplies and control possibilities for propellant injection and these can also not be provided by the prior art arrangements. The case is similar with respect to variability of the projectile ejection velocity and temperature influences, for example, as a result of so-called "warming up" of the gun barrel.

Additionally, in some prior art arrangements the introduction of the projectiles is relatively complicated as disclosed in, for example, German Patent No. 1,728,077.

In an arrangement disclosed, for example, in German Patent No. 2,226,175 and corresponding U.S. Pat. No. 3,763,739, there exists an additional drawback in that damping of components sometimes charged with high velocities is possible only conditionally, which sometimes brings about considerable and undesirable excess material stresses and interferes with the resistance to malfunctions of a gun, particularly during continuous operation.

SUMMARY OF THE INVENTION

It is an object of the invention to eliminate the above-described drawbacks as much as possible. In particular, an injection device is to be made available which is simple in configuration, reliable in operation and easily manipulated. Additionally, this device is to be accessible to monoergolic and diergolic, hypergolic propellants and to permit easy insertion of the projectiles and easy dosaging of the propellant quantity required.

The present invention is based on the realization that optimized propellant injection and thus combustion can be realized by a change in the structural design and association of individual components of the injection device while simultaneously permitting quantitative control of the combustion process.

Accordingly, the present invention provides that, in an injection device of the above-mentioned type, slide and pump piston are designed as mutually freely movable components, and a means for developing a pressure is provided for displacing the slide by such pressure, preferably such means including means for using a separate priming charge, the propellant and/or the pump piston. It is important in this connection that this invention does not propose a mechanical injection control with the above-described drawbacks but, as provided in a preferred embodiment, that the pressure released by a priming charge serves to cause the components to be displaced and, in particular, to open the injection nozzles in the injector surface.

The inventive idea can be realized by various concrete embodiments.

One advantageous embodiment of the invention provides that the pump piston is configured as a component which passes around or behind the slide so that, the space enclosed by the pump piston simultaneously defines the pump chamber. The frontal face of the slide is then preferably configured such that it is spaced at least in part from the outer section of the corresponding surface of the pump piston. In a particularly preferred embodiment, this may be realized by an annular seal projecting approximately centrally in the region of the frontal face of the slide.

If then, as provided in a further advantageous embodiment of the invention, a priming charge is fired in a pressure chamber disposed behind the pump piston, the pressure generated thereby will initially push the pump piston forward and create excess pressure in the pump chamber. This hydraulic pressure then acts on the corresponding differential face of the slide and presses it forward at high speed, simultaneously exposing the injector surface. A further feature of the invention provides that the slide and/or the pump piston are mounted, in the direction of movement, against a prestressed or biasing device, preferably a spring bearing. The force of a spring thus presses the control slide over the injector surface.

The pressure which continues to act on the frontal face of the pump piston likewise pushes the pump piston forward; however, this occurs at a somewhat slower speed than the slide and thus causes more propellant to be injected into the combustion chambers through the openings in the injector surface in that the pump chamber volume is constantly reduced.

An alternative embodiment provides that the pressure of the priming charge acts not only on the pump piston but, via an appropriate channel arrangement, also on the frontal face of the slide itself so that the latter is pressed over the injector surface directly by the generated gas pressure.

It is then of particular advantage for the pressure chamber to be connected with the combustion chamber by means of a connecting conduit. In that case, the priming charge can be effected pyrotechnically by way of an additional charge fastened to the projectile. It is also possible, however to fire the priming charge by injecting a partial quantity of propellant with extraneous energy branched off and stored, for example, by tensioning a spring when the breechblock is opened.

The device according to the invention permits a rotationally symmetrical arrangement of the components around a cylindrical combustion chamber, in which case the slide has the shape of a sleeve, and the pump chamber is annular as is the pump piston. An arrangement is also possible in which a plurality of pump chambers are disposed around the combustion chamber, with each pump chamber then having its own arrangement of pump piston and slide for the respective injector surface.

The arrangement according to the invention makes it possible in a particularly simple and advantageous manner to provide a device for controlling the movement of the pump piston during the introduction of the propellant and to thus provide a device for dosaging the quantity of propellant to be introduced into the respective pump chamber.

Preferably, the device may also include an abutment which can be adjusted along the path of movement, and/or of a guide member, particularly a guide piston. For example, a simple limitation of the displacement of the pump piston makes it possible to set the volume in the pump chamber and thus the quantity of propellant employed in practically infinite variations.

In a further advantageous embodiment of the invention, a valve is provided which connects a propellant conduit with the pump chamber. Together with the above-mentioned guide member, this valve can then not only be used to supply the pump chamber but also to empty it, for example upon termination of firing.

There are many additional advantages of the arrangement according to the invention. In particular, no mechanical adjustment members are required; rather, the displacement of the individual components is effected by way of the appropriate gas pressure and/or hydraulic pressure. Due to the arrangement according to the invention, the propellant can also simultaneously be utilized to hydraulically brake the pump piston as well as the control slide.

In an advantageous embodiment of the invention it is provided, in this connection, that the circumferential face of the control slide includes, at its free end projecting into the pump chamber, one or a plurality of projections and the receptacle into which the slide is pushed if it is advanced, has a correspondingly widened portion at its input. On the basis of the tapering annular gap formed during the displacement between receptacle and slide, the speed of the slide is thus attenuated.

The same principle is also utilized to brake the pump piston. The advanced pump piston causes the influx of propellant to the injection nozzles to be constricted and thus the velocity of the pump piston is damped, since the propellant exerts a correspondingly larger counterpressure.

The device according to the invention permits the use of monoergolic as well as diergolic, hypergolic propellants. For monoergolic propellants which must be injected uniformly, a cylindrical combustion chamber with rotationally symmetrically arranged slide and pump piston, respectively, is preferably provided. An embodiment having a plurality of separate pump chambers arranged around the charge or combustion chamber is proposed for the use of diergolic, hypergolic propellants. Different propellants are then injected into the combustion chamber from the separate pump chambers through the corresponding injection regions and mix to react with one another in the combustion chamber.

As a whole, the device according to the invention, with its regenerative fluid drive, provides improved and particularly controlled internal ballistics, due to its particular structural design, to permit its use in different caliber tank and artillery guns. The possibility of dosaging the propellant, which is considered to be a special feature of the invention makes it possible to realize controlled combustion. The structural association of the individual components makes additional recoil brake elements substantially superfluous. Rather, the propellant itself takes over this task and it is possible to inject the propellant into the combustion chamber at a high injection pressure.

A fluid propellant gun requires a gastight breechblock which is tight not only during firing. If there are leaks in the pump chamber, the escaping propellant is gasified in the hot gun barrel and must then not act on the crew.

In this connection, an advantageous feature of the invention provides in a particularly simple manner to additionally seal the components against one another by means of appropriate sealing rings. This is particularly easy in connection with rotationally symmetrical components, which is a further advantage of the present invention.

Indirectly, the arrangement according to the invention provides the advantage that it is particularly easy to supply the gun with new projectiles. Due to the provision of radial injection and the appropriate arrangement of the components of the injection device, the area in the extension of the gun barrel can be extended rearwardly, behind the combustion chamber, so as to accommodate the projectile, with new projectiles being supplied through the gun barrel section then formed. This can be done in a particularly simple manner by means of automatic control. A relatively simple breechblock, which can be moved out of the blocking position, reliably seals the combustion chamber during firing. Preferably, a mushroom-type breechblock is provided, as known, for example, for artillery guns.

BRIEF DESCRIPTION OF THE DRAWINGS

Two embodiments of the invention will now be described in greater detail and are additionally schematically illustrated in the drawing figures, wherein.

DESCRIPTION OF THE PREFERRED EMBODIMENTS

Figure 1A:
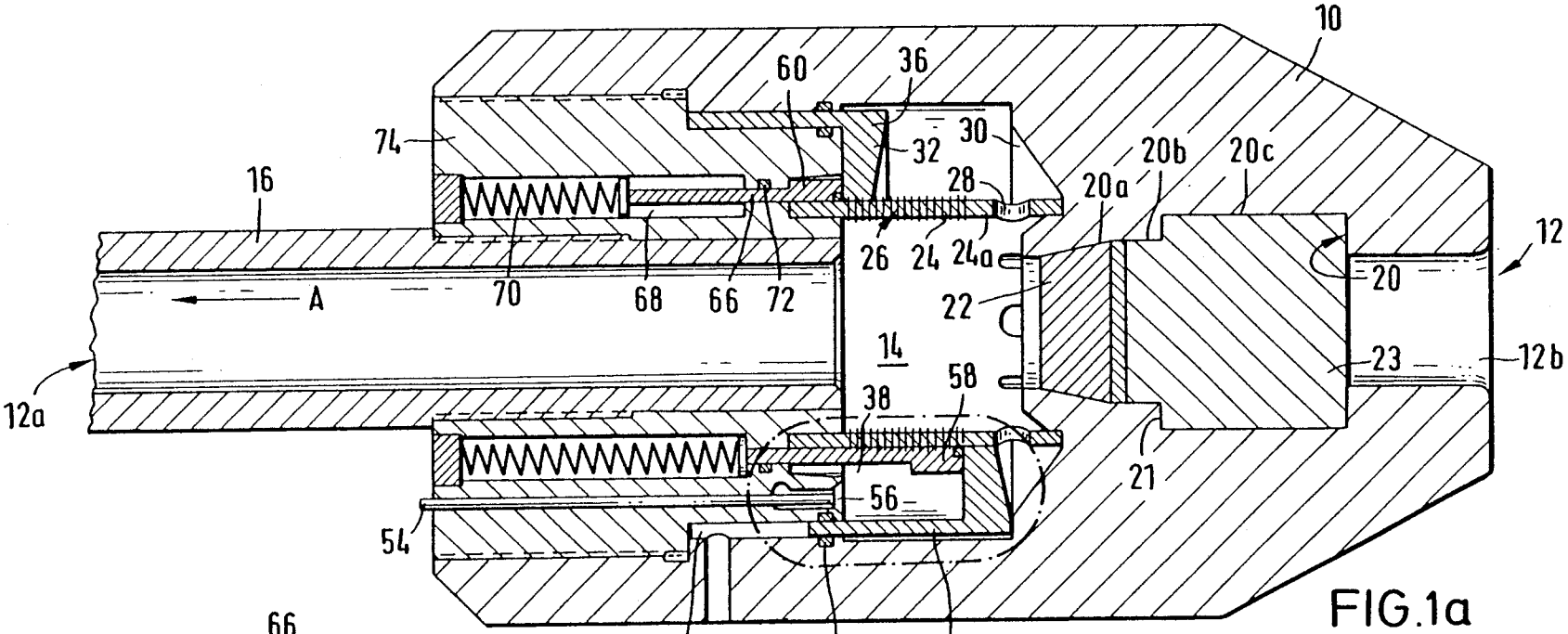
FIG. 1*a* is a longitudinal sectional view of a fluid propellant gun which is equipped with an injection device according to one embodiment of the invention.

The fluid propellant gun according to FIG. 1*a* includes a breech ring 10 having an approximately rectangular cross section. Breech ring 10 has a circular bore 12 in its center. Approximately in the middle of the longitudinal extent of bore 12, a combustion chamber 14 is provided which has a larger cross section than bore 12. In the front portion 12*a*, of bore 12 (to the left of combustion chamber 14 in FIG. 1*a*), bore 12 is surrounded by a tube 16 which serves to accommodate a projectile (not shown).

The rear portion 12*b* of bore 12 (to the right of combustion chamber 14 in FIG. 1*a*) has essentially the same cross section as front portion 12*a*. Immediately following combustion chamber 14, however, a transverse channel 20 extending perpendicularly to bore 12*b* (and perpendicularly to the plane of the drawing) opens into bore 12*b*. While the side of transverse channel 20 shown on the left in FIG. 1*a* has a height corresponding to the diameter of bore 12*b*, transverse channel 20 continues from there as a conically widening section 20*a* which is followed by a section 20*b* having a rectangular cross section, with a step 21 extending outwardly from there, again followed by a further section 20*c* having an unchanging cross section. In the region penetrated by transverse channel 20, bore 12*b* is made correspondingly wider.

A wedge-type breech 23 having a mushroom-type breechblock 22, as known, for example, in artillery guns, is seated in transverse channel 20. Mushroom-type breechblock 22 can be moved out of the region of bore 12*b* by pivoting it within transverse channel 20 after wedge-type breech 23 has been opened, thus freeing bore 12*b* so that a projectile can be brought into tube 16.

The circumferential wall of cylindrical combustion chamber 14 is formed by an injector surface 24. While the rear portion 24*a* of injector surface 24 facing mushroom-type breechblock 22 has a closed configuration, the remaining portion is provided with radially extending apertures (injection nozzles) 26. The injector surface 24 is held stationary in breech ring 10. Large radially extending openings 28 are provided in the closed portion 24*a* of injector surface 24 and these openings constitute a connecting conduit to an annular chamber 30 following toward the outside. As shown particularly in the sectional views of FIGS. 1*a* and 1*b*, chamber 30 has an approximately triangular cross section. As is evident from FIG. 1*a*, openings 28 are distributed over the cylindrical injector surface portion 24*a* at uniform distances from one another.

A pump piston 32 is seated on the exterior of injector surface 24. Pump piston 32 is an annular piston which has a jacket face 34 and a projection 36 projecting inwardly at a right angle from its end. This projection has an approximately trapezoidal cross section.

The outer jacket face 34 of pump piston 32 rests against the corresponding wall of a cylindrical recess 38 in breech ring 10 and its inner frontal face 36*a* (FIG. 1*b*), which has the shape of a cylinder section, rests against the outer surface of injector surface 24 and is guided so as to be longitudinally displaceable in recess 38 which constitutes the pump chamber. Breech ring 10 has an annular gap 40 to receive jacket section 34 if pump piston 32 is displaced accordingly which will be described in greater detail below.

Shortly before annular gap 40 opens into recess or pump chamber 38, there is provided an annular seal 42 to seal the pump chamber 38 against chamber 40.

Figure 1B:
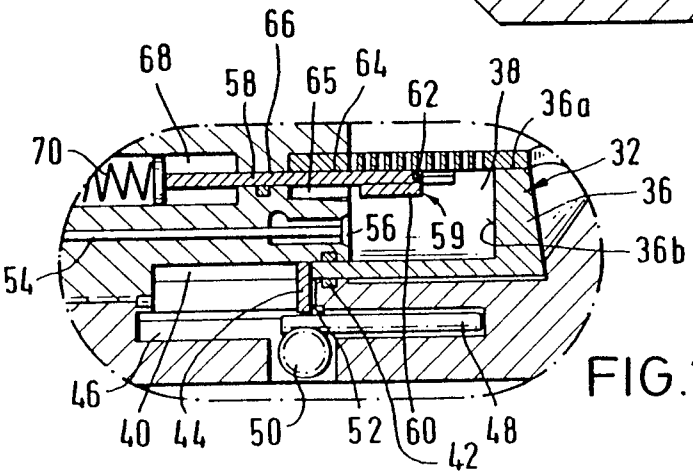
FIG. 1*b* is an enlarged view of the region around the pump chamber in the injection device according to FIG. 1*a*.

As is evident particularly from FIG. 1*b*, the section of annular gap 40 opposite seal 42 is made wider toward the outside. An abutment 44 is accommodated in the corresponding chamber section. This abutment projects perpendicularly outwardly from the free frontal end of jacket section 34 of pump piston 32.

Annular gap 40 widens and forms a chamber 46 parallel to jacket section 34 to accommodate a toothed rod 48 which is displaceable parallel to jacket section 34 by means of a drive wheel 50. At its end corresponding to abutment 44, toothed rod 48 is equipped with a cam 52.

The arrangement of toothed rod 48, drive wheel 50 and cam 52 serves to limit the displacement path of pump piston 32 in that, with toothed rod 48 in the appropriate position, abutment 44 is brought against cam 52.

A conduit 54 extending parallel to bore 12 in breech ring 10 opens, at a distance from annular gap 40, into a valve 56 disposed in the frontal face (on the left in FIG. 1*a*) of pump chamber 38 and permits the intake of propellant into pump chamber 38. However, the valve can also be set to cause pump chamber 38 to be emptied, as will be described in greater detail below.

A sleeve-shaped slide 58 is seated on injector surface 24 and is provided, at its end facing projection 36, with an external circumferential projection 60.

As is evident particularly from FIG. 1*b*, an annular seal 62 is seated on frontal face 59 of slide 58 and somewhat projects beyond frontal face 59 in the direction toward projection 36 of pump piston 32. The respective dimension lines for annular seal 62 can be seen in FIG. 1*b*. Annular seal 62 takes care that frontal face 59 is held at a distance from the corresponding wall 36*b* of projection 36. An annular gap 64 is provided in breech ring 10 to accommodate the rear jacket section of slide 58. A first section 65 of gap 64, when seen from pump chamber 38, has a height which corresponds to slide 58 in the region of projection 60 and this is followed by a section 66 which has a height corresponding to the thickness of the jacket face of the slide. Section 66 changes to a wider annular chamber 68 in which a compression spring 70 is seated. An annular seal 72 is arranged around section 66.

The section of breech ring 10 accommodating annular gaps 40 and 64 as well as chamber 68 is formed by a correspondingly configured insert member 74.

The illustrated fluid propellant gun operates as follows:

First, propellant is introduced through conduit 54 and valve 56 into pump chamber 38, with pump piston 32 being moved to the right (opposite to arrow A in FIG. 1*a*) and the volume of pump chamber 38 constantly increases correspondingly. Due to the action of spring 70, slide 58 follows. By way of the corresponding setting of toothed rod 48, the maximum displacement of pump piston 32 can be set in that the corresponding abutment 44 abuts against cam 52 of toothed rod 48. Then valve 56 is closed e.g by shutting off the supply of pressured propellant. The device is then in an arrangement as shown in the lower portion of FIG. 1*a;* in particular, frontal face 59 (seal 62) of slide 58 lies against abutment 36 of pump piston 32 and pump chamber 38 is filled with propellant.

By means of one of the above-described alternative possibilities, a priming charge is then applied, preferably by way of an additional charge attached to the projectile (not shown) in the region of combustion chamber 14. Gas is pressed into annular chamber 30 through openings 28 and associated connecting conduits and gas pressure is exerted onto the rear frontal face of projection 36 of pump piston 32. Once a certain pressure has been reached, due to the very rapid pressure build-up which takes only milliseconds or less, pump piston 32 is pressed forward (in the direction of arrow A) and produces excess pressure in pump chamber 38. This hydraulic pressure acts on the differential face of slide 58 in the region of its frontal face 59 in front of seal 62 and pushes the slide 58 forward against the force of compression spring 70 in the direction of arrow A. The movement of slide 58 is here faster than that of pump piston 32 so that the injector surface 24 and its openings 26 are temporarily exposed and propellant is able to escape through openings 26 into combustion chamber 14. In combustion chamber 14, the propellant is then combusted and more pressure is generated to eject the projectile. At the same time, pump piston 32 follows slide 58 because of the gas pressure generated in the rear so that the pump chamber volume 38 is reduced correspondingly.

When the slide 58 advances further, the widened region 65 of annular gap 64 acts as a brake chamber because of the constricted propellant influx region.

With the movement of pump piston 32, the previously opened apertures region in injector surface 24 is continuously closed again and simultaneously, because of the reduction in the number of outlet openings for the propellant and the thus increased hydraulic pressure, the pump piston is decelerated.

For the subsequent new filling of pump chamber 38, propellant is introduced through conduit 54 and valve arrangement 56, and with increasing fill level pump piston 32 and slide 58, which follows due to the spring action, are returned to their starting positions.

The above-described process is then repeated in the same manner, with a new projectile first having been introduced into tube 16 after breechblock 22, 23 is folded away.

Figure 2:
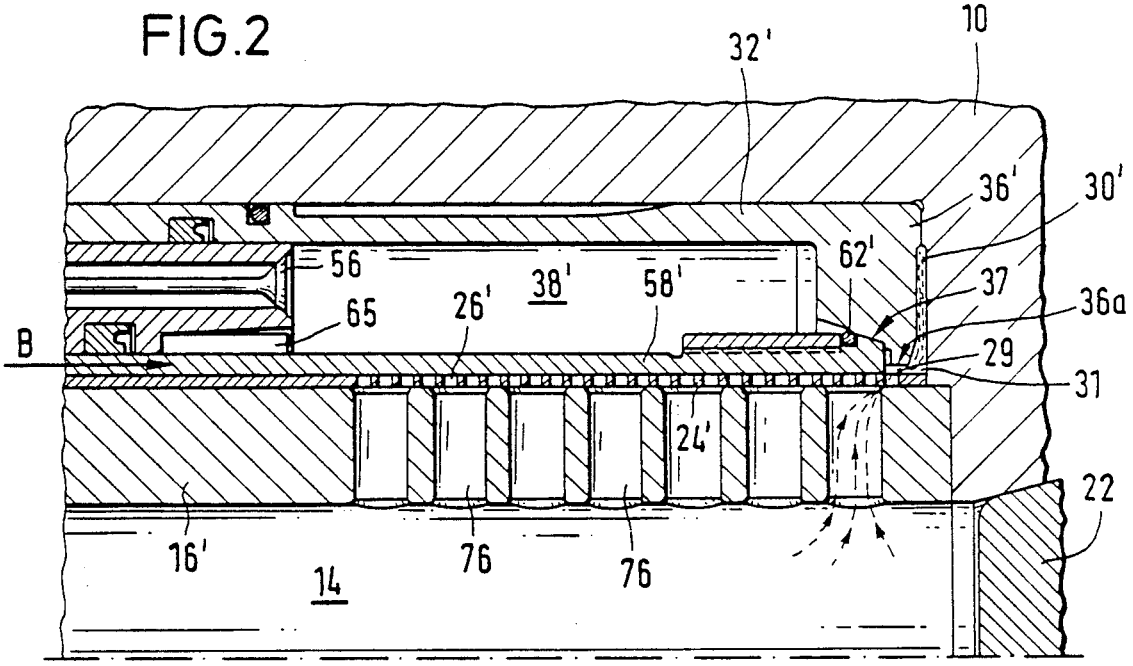
FIG. 2 is an enlarged view of a section between combustion chamber and pump chamber in a second embodiment of the injection device according to the invention.

FIG. 2 shows a different embodiment which is distinguished, in particular, by a different configuration of the region around openings 28 of FIG. 1*a*. As can easily be seen in FIG. 2, a frontal face 36*a* of projection 36′ of annular pump piston 32′ does not rest on injector surface 24′, but ends at a distance therefrom. Moreover, projection 36′ has a step 37 which steps back toward pump chamber 38′. In the starting position for control slide 58′ as shown in FIG. 2, the front end of control slide 58′ which is designed to correspond to step 37, extends over this step 37. A seal 62′ disposed between the corresponding faces of control slide 58′ and pump piston 32′ takes care that no propellant can escape from pump chamber 38′ when slide 58′ is closed.

Injector surface 24′ is designed such that, with the arrangement of control slide 58′ and pump piston 32′ in the staring position, an open connection exists from combustion chamber 14 to chamber 30′, via the area between the front end 36*a* of projection 36′ and the outer surface of injector section 24′, respectively.

When a priming charge is fired, gas is able to flow through corresponding passage openings 29 into a chamber 31 disposed downstream thereof and into chamber 30′, respectively, with gas pressure being exerted not only on the rear frontal face of projection 36′ of control slide 32′, as in the embodiment according to FIGS. 1*a* and 1*b*, but particularly also on the end face of control slide 58′ which is then opened spontaneously immediately after the pressure build-up and snaps away in the direction opposite to arrow B (arrow B symbolizes the permanent force of spring 70) to thus open apertures 26′ of injector section 24′ so that propellant can be injected from pump chamber 38′ into combustion chamber 14.

Control slide 58′ is here opened before pump piston 32′ is displaced, with the latter then following, as described in connection with FIGS. 1*a* and 1*b*, and again gradually covers the exposed apertures 26′. The braking effect on control slide 58′ and pump piston 32′ on the part of the propellant is the same as described in connection with the first embodiment.

FIG. 2 shows injector section 24′ supported by tube 16′ which is extended rearwardly into combustion chamber 14 and is likewise provided with openings 76 extending radially toward combustion chamber 14 in the region of apertures 26′ but, as can be seen clearly in FIG. 2, these openings have a much larger cross section than apertures 26′. The gas then flows from combustion chamber 14 through respective openings 76, 26′ into chamber 30′.

Instead of an annular pump chamber, it is also possible to realize the present invention in the context of a plurality of pump chambers disposed around the combustion chamber, with each pump chamber having its own arrangement of pump piston and slide for a respective injector surface as disclosed in FIGS. 1 and 2 of U.S. patent application Ser. No. 06/948,092, first mentioned above and incorporated herein by reference. When there are two such pump chambers, they are preferably disposed so that their center points lie on an imaginary diagonal line the rectangular cross section of breech ring 10 drawn through the center of the combustion chamber as shown in FIG. 2 of the above mentioned patent application.

It will be understood that the above description of the present invention is susceptible to various modifications, changes and adaptations, and the same are intended to be comprehended within the meaning and range of equivalents of the appended claims.

We claim:

1. In an injection device for fluid propellants for a fluid propellant gun having a combustion chamber, the injection device including: at least one pump chamber for accommodating a propellant; a pump piston movable in the pump chamber; an injector surface which at least partially surrounds the combustion chamber and is disposed approximately radially of the combustion chamber with respect to the direction of ejection of a projectile from the gu, the injector surface having apertures through which propellant can flow between the pump chamber and the combustion chamber; and a movable slide disposed in said pump chamber adjacent said injector surface for opening and closing said apertures; the improvement wherein:

said slide and said pump piston are mutually freely movable components relative to each other and to said injector surface; and further including means, responsive to a gas pressure produced in the combustion chamber, for developing a pressure for displacing said slide.

2. Device as defined in claim 1 wherein said slide has a free frontal face adjacent to a portion of said pump piston and further including a projecting seal provided in a region of the free frontal face of said slide, said region being located approximately in the center of said free frontal face.

3. Device as defined in claim 1, wherein said pump piston has an inner wall and said slide has a free frontal face adjacent to said inner wall, said free frontal face being configured so that it is spaced in part, at least in an outer section relative to said injector surface, from the inner wall of said pump piston.

4. Device as defined in claim 1, wherein said injector surface, said slide and said pump piston are each configured as rotationally symmetrical components.

5. Device as defined in claim 1, and further including means for braking movement of said slide and said pump piston with the use of propellant.

6. Device as defined in claim 1, wherein said slide has a free end opposite said injector surface and is provided with a projection which projects outwardly relative to said injector surface; and further including means defining a receptacle for receiving said slide once said slide is moved to expose said injector surface, said receptacle having an inlet region somewhat wider than a remaining portion of said receptacle, said inlet region being of the same size or somewhat larger than the free end of said slide for accommodating said projection, wherein said free end can come to rest within said receptable.

7. Device as defined in claim 1 further including a gun tube for receiving a projectile, with said tube having a section which extends into said combustion chamber parallel to said injector surface and which is provided with a plurality of openings, said openings having a much larger cross section than the apertures in said injector surface.

8. Device as defined in claim 1, wherein said means for developing a pressure includes means for using a propellant for developing such pressure.

9. Device as defined in claim 1, wherein said means for developing a pressure includes means for using said pump piston for developing such pressure.

10. Device as defined in claim 1, wherein said pump piston surrounds said slide.

11. Device as defined in claim 10, wherein said slide has a free frontal face opposite said injector surface, and when said slide is in closed position covering the apertures of said injector surface, said free frontal face can be brought to lie against a portion of said piston.

12. Device as defined in claim 1, and wherein said means for developing a pressure includes means defining a cavity disposed in front of one end of said slide and one end of said pump piston.

13. Device as defined in claim 12, and wherein said means for developing a pressure includes means defining at least one conduit via which said cavity is in communication with said combustion chamber.

14. Device as defined in claim 1, wherein said injector surface comprises a cylindrical jacket surrounding the combustion chamber, and said slide and said pump piston are annular components arranged around said injector surface.

15. Device as defined in claim 14, and wherein said means for developing a pressure includes means defining an annular cavity disposed in front of one end of said slide and one end of said pump piston; and a plurality of conduits which are radially and uniformly distributed around said cylindrical jacket and which open into said annular cavity, said annular cavity constituting a pressure chamber.

16. Device as defined in claim 1, and further including means for limiting the path of movement of said pump piston with respect to said slide and said injector surface, respectively.

17. Device as defined in claim 16, wherein said means for limiting the path of movement of said pump piston comprises one of an abutment which is displaceable along the path of movement or a guide piston.

18. Device as defined in claim 1 and further including, a propellant conduit and a valve for connecting said propellant conduit with said pump chamber.

19. Device as defined in claim 18, wherein said pump piston surrounds said injector surface and said slide and is spaced from said injector surface and said slide, respectively to define said pump chamber.

20. Device as defined in claim 1, and further including a biasing means, wherein said slide and said pump piston are mounted axially against said biasing means.

21. Device as defined in claim 20, wherein said biasing means comprises a spring.

22. Device as defined in claim 21 wherein said device is disposed in the breech ring of a fluid propellant gun, wherein said beech ring has a recess, and wherein said spring is disposed in said recess.

23. A fluid propellant gun including an injection device as defined in claim 1.

24. A fluid propellant gun as defined in claim 23, wherein said injection device is arranged rotationally symmetrically around said combustion chamber.

25. A fluid propellant gun as defined in claim 23, wherein said gun includes a tube for carrying a projectile, and said injection device is disposed to be rotationally symmetrical with said tube.

26. In a fluid propellant gun having a combustion chamber and an injection device for injecting fluid propellants into said combustion chamber, with said injection device including at least one pump chamber for accommodating a propellant to be injected, a pump piston movable in said pump chamber, an injector surface which at least partially surrounds the combustion chamber and is disposed approximately radially of the combustion chamber with respect to the direction of ejection of a projectile from the gun, said injector surface having apertures through which propellant can blow between the pump chamber and the combustion chamber, and a movable slide disposed in said pump chamber adjacent said injector surface for covering and uncovering said apertures; the improvement wherein:

said side and said pump piston are mutually freely movable components relative to each other and to said injector surface; and further including means for causing displacement of said slide in response to a gas pressure developed in at least one of said injector device and said combustion chamber.

27. A fluid propellant gun as defined in claim 26, wherein said means for causing displacement displaces said sleeve in response to a gas pressure developed in said combustion chamber.

28. A fluid propellant gun as defined in claim 27, wherein said means for causing displacement includes said pump piston.

29. A fluid propellant gun as defined in claim 28 wherein said means for causing displacement further includes means defining a cavity disposed at the rear end of said pump chamber and forming a pressure chamber with the adjacent end surface of said pump piston when said pump piston and said slide are positioned so that said slide covers aid apertures, and at least one open conduit connecting said cavity with said combustion chamber, whereby initial displacement of said pump piston and said slide to uncover some of said apertures can be caused by gas pressure produced in said combustion chamber by a primary charge disposed in the combustion chamber.

30. A fluid propellant gun as defined in claim 29 wherein: at least a portion of the rear end surface of said slide sealingly engages the front end surface of said pump piston when said slide and said pump piston are positioned so that said slide covers said apertures; and said means for causing displacement further includes means defining a further cavity between a further portion of said rear end surface of said slide and said front end surface of said pump piston, with said further cavity being in open communication with said at least one open conduit.

* * * * *